US006779851B2

(12) United States Patent
Bouchiere

(10) Patent No.: US 6,779,851 B2
(45) Date of Patent: Aug. 24, 2004

(54) METHOD OF PRODUCING A BRUSH HAVING A BRISTLE PLATE

(75) Inventor: Bart Gerard Bouchiere, Izegem (BE)

(73) Assignee: G.B. Boucherie, N.V., Izegem (BE)

( * ) Notice: Subject to any disclaimer, the term of this patent is extended or adjusted under 35 U.S.C. 154(b) by 340 days.

(21) Appl. No.: 09/822,865

(22) Filed: Apr. 2, 2001

(65) Prior Publication Data

US 2001/0050507 A1 Dec. 13, 2001

(30) Foreign Application Priority Data

Apr. 6, 2000 (DE) ..... 200 06 311 U

(51) Int. Cl.[7] ..... A46D 3/00
(52) U.S. Cl. ..... 300/21; 15/167.1; 15/191.1
(58) Field of Search ..... 15/167.1, 191.1, 15/192, 193; 300/21

(56) References Cited

U.S. PATENT DOCUMENTS 2,576,546 A * 11/1951 Starr ..... 300/21
2,878,069 A * 3/1959 Wessel, Jr. ..... 300/21
5,033,797 A 7/1991 Rueb
5,217,279 A 6/1993 Newell
5,242,235 A * 9/1993 Li ..... 15/167.1
5,350,219 A * 9/1994 Shou-Jen ..... 300/21

FOREIGN PATENT DOCUMENTS

BE 1 009 925 A 11/1997
DE 28 50 594 A1 6/1980
DE 37 12962 A1 11/1988

OTHER PUBLICATIONS

European Search Report (Dated May 2, 2003).

* cited by examiner

*Primary Examiner*—Theresa T. Snider
(74) *Attorney, Agent, or Firm*—Stuart J. Friedman

(57) ABSTRACT

A method of producing brushes by connecting plates of a plastic material, having each tufts of brush bristles attached thereto and projecting from a first face, to an attachment surface portion of a brush body made of plastic, in particular the same plastic, by means of ultrasonic welding of gluing. Each of the plates has a peripheral rim facing the brush body and having an edge formed thereon which acts as an energy concentrator in ultrasonic welding.

33 Claims, 4 Drawing Sheets

METHOD OF PRODUCING A BRUSH HAVING A BRISTLE PLATE

FIELD OF INVENTION

The invention relates to a method of producing brushes by connecting plates of a plastic material, having each tufts of brush bristles attached thereto and projecting from a first face, to an attachment surface portion of a brush body made of plastic, in particular the same plastic, by means of ultrasonic welding or gluing.

BACKGROUND OF THE INVENTION

It is known in brush making to attach tufts of bristles to carrier plates which are then attached to a brush body. The attachment of the carrier plates to the brush bodies can be done by welding, in particular when the carrier plates and the brush bodies are made of the same plastic material. At the junction between the carrier plate and the surface of the brush body a gap may be produced which is undesirable both for reasons of aesthetics and also for reasons of hygiene.

BRIEF SUMMARY OF THE INVENTION

The invention provides a method of reliably connecting the carrier plate to the brush body without an undesirably large gap remaining between the carrier plate and the brush body.

In accordance with a first aspect of the invention, the plastic materials of the plate and the brush body are connected by ultrasonic welding. Formed on the peripheral rim of the plate is an edge facing the brush body and acting as an energy concentrator in ultrasonic welding. Welding is therefore effected with high precision, so that also in mass production such as in the case of toothbrushes, for example, the plate is attached to the brush body with a precise fit. The edge preferably tapers toward the brush body. In an advantageous embodiment of the method the brush body is provided with a recess into which the plate can be inserted with a precise fit. The gap remaining between the outer edge of the plate and the rim of the recess will then be very small and barely perceptible.

In this embodiment of the method, the edge engages the bottom of the recess by its tapered end, so that the weld joint is produced at the bottom of the recess. The welding process is further assisted by a pressing means which presses the plate against the bottom of the recess of the brush body.

Preferably, an extension projecting beyond the recess of the brush body is formed at the peripheral rim of the plate. This extension may extend over the entire periphery of the plate or only over a part thereof, preferably over that part which extends as far as into the neck piece of the brush body in the case of a toothbrush. Bending loads occur at this point which cause any gap that possibly remains between the plate and the brush body to be opened when the head of the toothbrush is bent back in use. This extension, too, is preferably provided with a tapered edge which faces the brush body and acts as an energy concentrator in ultrasonic welding.

Any gap that may still be left between the plate and the brush body may be closed by a finishing treatment, in particular by filling it with a suitable plastic mass. More particularly, the brush body with the plate already fitted therein may be placed in an injection mold which is used to apply a molding over the gap so as to completely fill it and close it.

In an alternative embodiment of the method according to the invention, the brush body is provided with a recess into which the plate is inserted with a precise fit and attached there by means of an adhesive. Also in this embodiment, any gap possibly left between the plate and the brush body may be closed by molding in an injection mold.

In a further embodiment of the invention, the plates are attached to the brush bodies using a combination of ultrasonic welding and glueing. In particular, the load-bearing fastening of the plate may be performed by welding it to the bottom of the recess of the brush body, whereas the adhesive is introduced into the gap remaining between the plate and the brush body and fills the same.

SHORT DESCRIPTION OF THE DRAWINGS

Further features and advantages of the invention will be apparent from the following description of several embodiments of the method and from the drawings to which reference is made and in which.

DETAILED DESCRIPTION OF THE INVENTION

Figure 1:
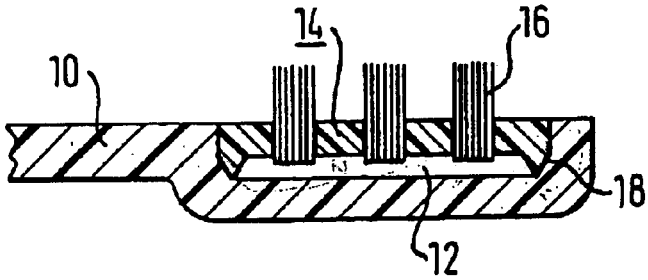
FIG. 1 is a schematic sectional view of the head portion of a toothbrush which may be manufactured in the method according to the invention.
Figure 2:
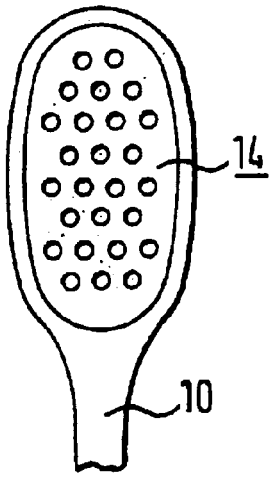
FIG. 2 shows a top view of the head portion of the toothbrush.

In the embodiment of the method shown in FIG. 1 a recess 12 is formed in the head portion of a toothbrush body 10. A carrier plate 14 is fittingly inserted in this recess 12. The carrier plate 14 has a number of through holes having tufts 16 of bristles inserted and fastened therein. An edge 18 is formed on the peripheral rim of the carrier plate 14 and tapers toward the bottom of the recess 12. The brush body 10 and the plate 14 are preferably made of the same plastic, such as, e.g., polypropylene.

An apparatus for making such a toothbrush using the method according to the invention comprises an ultrasonic welding device and a pressing means. The ultrasonic welding device acts, just like the pressing means, on the peripheral rim of the carrier plate 14, with the tapered edge 18 acting as an energy concentrator, with the result that a reliable load-bearing weld joint is produced at the bottom of the recess 12 between the brush body 10 and the plate 14.

The welding is effected with high precision so as to ensure a very precise fit of the plate 14 on the brush body 10.

But a small gap may still remain between the peripheral rim of the plate 14 and the surface of the brush body 10 surrounding the plate.

Figure 3:
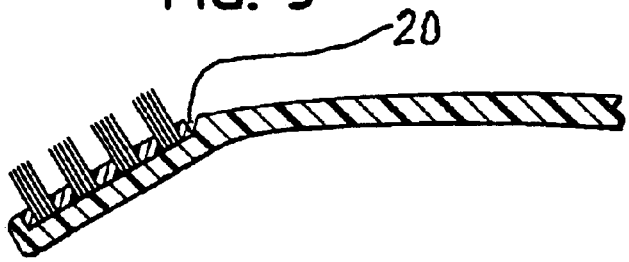
FIG. 3 is a schematic sectional view of a toothbrush deformed by bending loads in use.

As is illustrated in FIG. 3, this gap 20 may become wider by the bending load occurring when the toothbrush is in use.

Figure 4:
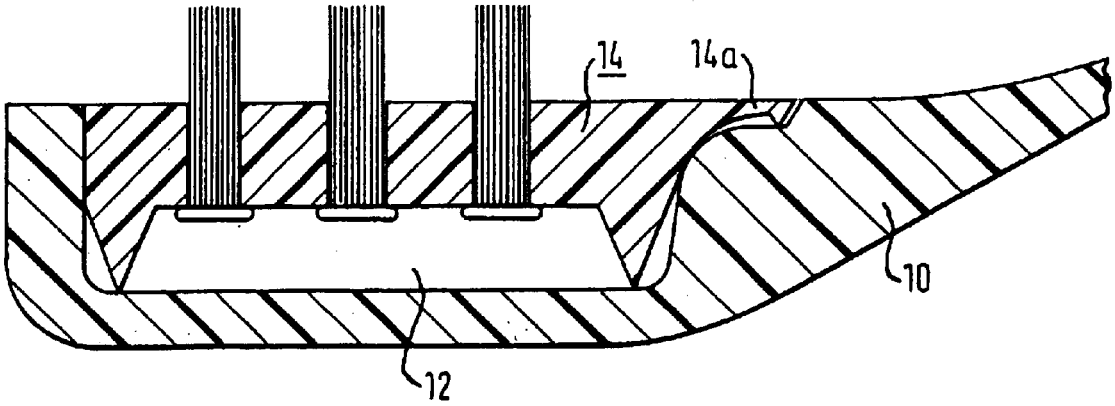
FIG. 4 is an enlarged view of a section taken through the head portion of a toothbrush manufactured in accordance with a preferred embodiment of the method.
Figure 5:
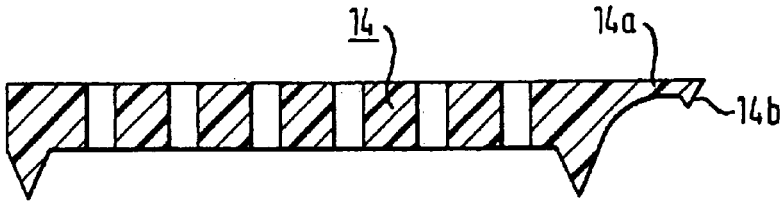
FIG. 5 shows a detailed view of the plate used in the embodiment of the method illustrated in FIG. 4.
Figure 6:
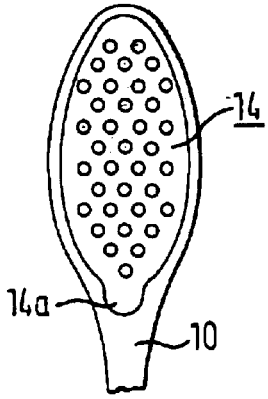
FIG. 6 shows a top view of the head of a toothbrush in accordance with the embodiment of FIG. 4.

This is prevented in the embodiment of the method as shown in FIG. 4 by providing the plate 14 with an extension

14*a* which extends as far as into the neck region of the brush body. In order to make sure that this extension 14*a* is securely welded to the brush body 10, the extension 14*a* is likewise provided with a tapered edge 14*b* on its side facing the brush body, the edge 14*b* acting as an energy concentrator in ultrasonic welding.

Figure 7:
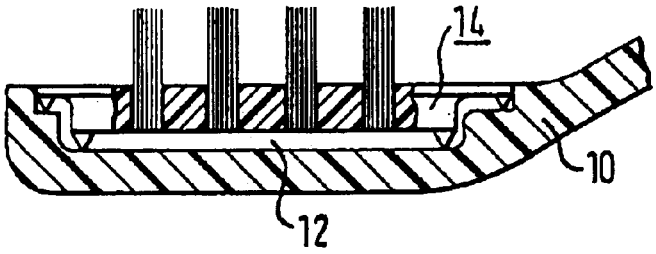
FIGS. 7 to 12 show sectional and partial views of toothbrushes which may be manufactured by employing several variants of the invention embodiments of the method.

In the embodiment shown in FIG. 7, the recess 12 is provided with a stepped shape at its peripheral rim and the plate 14 is provided with a peripheral rim designed to match this shape.

Figure 8:
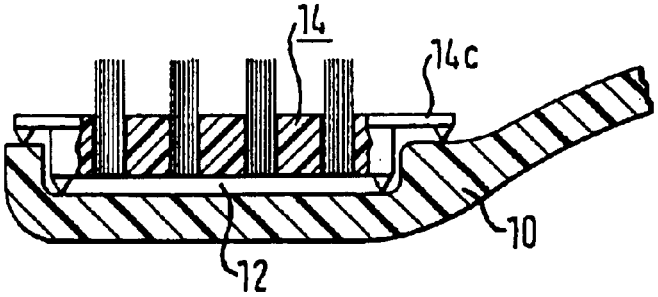

In the embodiment as shown in FIG. 8, a peripheral rim 14*c* is formed on the plate 14 which projects beyond the main body of the plate and has a tapered edge which rests on the surface of the brush body 10 surrounding the recess 12. In this embodiment an ultrasonic welding is also performed over the entire periphery of the plate 14.

Figure 9:
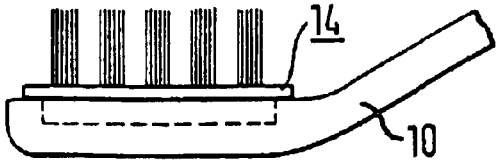

In the embodiment of the method as shown in FIG. 9, after the welding process the plate 14 has been pressed against the brush body 10 and has formed an intimate bond therewith over its entire periphery, so that no gap is produced at the junction between the plate 14 and the brush body 10.

Figure 10:
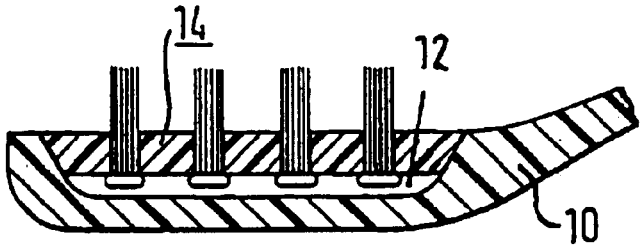

In the embodiment as shown in FIG. 10 the recess 12 has an oblique peripheral wall converging toward the inside of the brush body 10. The plate 14 has a peripheral wall of matching obliqueness, so that it is ensured that the plate 14 fits in the recess of the brush body with no gap in between. As in the embodiments shown above, the plate may in addition be provided with a tapered edge for welding to the bottom of the recess 12.

Figure 11:
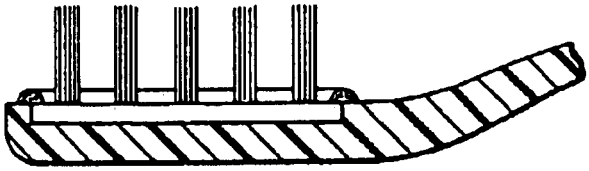
Figure 12:
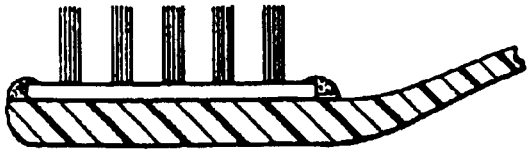

As shown in FIGS. 11 and 12, any gap possibly left between the plate and the brush body may be closed by filling it with a plastic mass. It is particularly expedient to fill this gap with a plastic mass by injection molding in an injection mold. By selecting an elastomer as the plastic mass, the plate will be given an elastic support on the brush body from all sides which can be used to cushion vibrations occurring in use.

In all of the embodiments shown, the connection of the plate 14 with the brush body 10 may alternatively or additionally be effected by means of an adhesive. The adhesive may also or additionally perform the function of filling any gap remaining between the plate and the brush body, thus removing the gap.

What is claimed is:

1. A method of producing brushes comprising the steps of providing brush bodies of a plastic material, said brush bodies each having an attachment surface portion, providing plates of a plastic material, said plates each having tufts of brush bristles attached thereto and projecting from a first face, connecting each plate to the attachment surface portion of one of the brush bodies by ultrasonic welding;

wherein said plates each have a peripheral rim on a second face opposite the first face, said peripheral rim defining an edge, and said plate contacting said attachment surface portion along said edge and said edge acting as an energy concentrator, said edge tapering toward said attachment surface portion, thus defining a tapered end of said peripheral rim.

2. The method of claim 1, wherein said brush bodies are provided with a recess and said attachment surface portion is located at the bottom of the recess.

3. The method of claim 1, wherein said edge engages said attachment surface portion by its tapered end and a weld joint is produced at said attachment surface portion.

4. The method of claim 3, wherein an extension projecting beyond said recess of said brush bodies is formed at said peripheral rim of said plate.

5. The method of claim 4, wherein said extension is made to contact a surface area of said brush bodies surrounding said recess.

6. The method of claim 5, wherein said extension is provided with an edge which tapers toward said brush body and acts as an energy concentrator in ultrasonic welding.

7. The method of claim 5, wherein said extension is formed in such a way that it protrudes as far as into a transition region of said brush bodies which corresponds to the neck piece of a toothbrush.

8. The method of ciaim 4, wherein said extension is inserted in a stepped widened portion of said recess in said brush bodies.

9. The method of claim 1, wherein a pressing means is provided for pressing said plate against said brush body during the ultrasonic welding.

10. The method of claim 1, wherein a gap left between said plate and said brush body is closed by plastic mass.

11. The method of claim 1, wherein a gap left between said plate and said brush body is closed by molding in an injection mold.

12. The method of claim 1, wherein said brush bodies are provided with a recess having a peripheral wall converging obliquely toward the center of said recess, in that said plate has a peripheral wall having a shape matching the shape of said peripheral wall of said recess and is fittingly inserted in said recess, and in that said plate is attached in said recess by ultrasonic welding or by means of,an adhesive.

13. The method of claim 1, wherein said brush bodies and said plates are made of the same plastic material.

14. A method of producing brushes comprising the steps of providing brush bodies of a plastic material, said brush bodies each having an attachment surface portion, providing plates of a plastic material, said plates each having tufts of brush bristles attached thereto and projecting from a first face, providing means for applying an adhesive in order to connect said plates to said attachment surface portions of said brush bodies by gluing;

wherein said brush bodies and said plates are made of the same plastic material, said brush bodies are provided with a recess in which the plate is inserted to fit and said attachment surface portion is located at the bottom of said recess, wherein an injection mold is provided in which part of said brush body with said plate inserted therein is provided for molding around at least the peripheral region of said plate.

15. The method of claim 14, wherein an injection mold is provided in which part of said brush body with said plate inserted therein is provided for molding around at least the peripheral region of said platelet.

16. A method of producing a brush comprising the steps of:

providing a brush body of a plastic material, said brush body having an attachment surface portion;

providing a plate of a plastic material, said plate having tufts of brush bristles attached thereto and projecting from a first face;

connecting said plate to said attachment surface portion of said brush body by ultrasonic welding;

wherein said plate has a second face opposite said first face, said plate having a circumferential rim projecting from said second face and defining an edge, and said plate contacting said attachment surface portion along said edge so that a first gap is formed between said attachment surface portion of said brush body and said second face of said plate, said edge acting as an energy concentrator.

17. The method of claim 16, wherein said edge tapers, toward said attachment surface portion, thus defining a tapered end of said circumferential rim.

18. The method of claim 17, wherein said edge engages said attachment surface portion by its tapered end and a weld joint is produced at said attachment surface portion.

19. The method of claim 16, wherein said brush body is provided with a recess and said attachment surface portion is located at the bottom of said recess.

20. The method of claim 19, wherein an extension projecting beyond said recess of said brush body is formed at said circumferential rim of said plate.

21. The method of claim 20, wherein said extension is made to contact a surface area of said brush body surrounding said recess.

22. The method of claim 21, wherein said extension is provided with an extension edge which tapers toward said brush body and said extension edge acts as an energy concentrator in the ultrasonic welding.

23. The method of claim 21, wherein said extension is formed in such a way that it protrudes as far as into a transition region of said brush body which corresponds to the neck piece of a toothbrush.

24. The method of claim 20, wherein said extension is inserted in a stepped widened portion of said recess in said brush body.

25. The method of claim 16, wherein a pressing means is provided for pressing said plate against said brush body during the ultrasomic welding.

26. The method of claim 16, wherein a second gap is left between the circumferential rim of said plate and said brush body is closed by a plastic mass.

27. The method of claim 16, wherein a second gap is left between the circumferential rim of said plate and said brush body is closed by molding in an injection mold.

28. The method of claim 16, wherein an injection mold is provided in which part of said brush body with said plate inserted therein is provided for molding around at least the peripheral region of said plate.

29. The method of claim 16, wherein an ultrasonic welding means for performing the ultrasonic welding is provided in combination with a means for applying an adhesive.

30. The method of claim 16, wherein said brush body is provided with a recess having a peripheral wall converging obliquely toward the center of said recess, in that said plate has a peripheral wall having a shape matching the shape of said peripheral wall of said recess and is fittingly inserted in said recess, and in that said plate is attached in said recess by ultrasonic welding.

31. The method of claim 16, wherein said brush body and said plate are made of the same plastic material.

32. A method of producing a brush comprising the steps of:

providing a brush body of a plastic material, said brush body having an attachment surface portion, providing a plate of plastic material, said plate having tufts of brush bristles attached thereto and projecting from a first face, providing means for applying an adhesive in order to connect said plate to said attachment surface portion of said brush body by gluing, wherein said brush body and said plate are made of the same plastic material, said brush body being provided with a recess in which said plate is inserted to fit and said attachment surface portion being located at the bottom of said recess, said plate having a second face opposite said first face, said plate having a circumferential rim projecting from said second face and defining an edge, and said plate contacting said attachment surface portion along said edge so that a gap is formed between said attachment surface portion of said brush body and said second face of said plate.

33. The method of claim 32, wherein an injection mold is provided in which part of said brush body with said plate inserted therein is provided for molding around at least the peripheral region of said plate.

* * * * *